US006427387B1

(12) United States Patent
Hunt

(10) Patent No.: US 6,427,387 B1
(45) **Date of Patent: *Aug. 6, 2002**

(54) REMOVABLE MULLION ASSEMBLY

(75) Inventor: Larry R. Hunt, Lenoir City, TN (US)

(73) Assignee: Yale Security, Inc., Monroe, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/427,813

(22) Filed: Oct. 27, 1999

(51) Int. Cl.[7] ..... E06B 5/00
(52) U.S. Cl. ..... 49/365; 292/219
(58) Field of Search ..... 49/365; 292/219; 70/58, 65, 57, 101; 160/17, 118, 119

(56) References Cited

U.S. PATENT DOCUMENTS

| | | | | |
|---|---|---|---|---|
| 2,275,730 A | | 3/1942 | Casse | 20/20 |
| 2,309,436 A | | 1/1943 | Blodgett | 189/16 |
| 3,319,382 A | | 5/1967 | Hand | 49/504 |
| 4,858,386 A | | 8/1989 | Nail | 49/505 |
| 5,299,437 A | | 4/1994 | Paugh | 70/101 |
| 5,435,102 A | | 7/1995 | McCarthy | 49/365 |
| 5,450,697 A | | 9/1995 | Prucinsky et al. | 52/210 |
| 5,471,792 A | | 12/1995 | Higgins et al. | 49/365 |
| 5,794,382 A | | 8/1998 | Prucinsky | 49/365 |
| 5,890,319 A | * | 4/1999 | Haeck et al. | 49/365 |

FOREIGN PATENT DOCUMENTS

| | | | |
|---|---|---|---|
| CA | 2146301 | 10/1995 | E06B/7/00 |

* cited by examiner

*Primary Examiner*—Jerry Redman
(74) *Attorney, Agent, or Firm*—Michael G. Johnston; Moore & Van Allen PLLC

(57) ABSTRACT

A removable mullion assembly comprises a fitting attached in the door opening for receiving an end of the mullion. The fitting houses a locking mechanism for selectively holding the mullion in place in the fitting. The locking mechanism comprises a latch bolt which in an extended position engages the end of the mullion and secures the mullion in the fitting. A key-operated mechanism, such as a cylinder lock, is operatively connected to the bolt for moving the latch bolt to the retracted position in response to turning the key in the cylinder. An actuating element is also provided which is activated by the end of the mullion as the mullion enters the retaining element for moving the bolt to the retracted position. The locking mechanism may further comprise a blocking element to block movement of the latch bolt from the extended position. The blocking element may be moved to the non-blocking position as the mullion is inserted into the retaining element by a release lever which is actuated by the end of the mullion or in response to turning the key in the cylinder. The new fitting allows the mullion to be mounted to the top fitting and in the door opening without the need for latch or lock components in the mullion. Having the lock mechanism permanently mounted in the fitting prevents damage and contamination to the components thereof when the mullion is removed and laid on the floor.

35 Claims, 7 Drawing Sheets

REMOVABLE MULLION ASSEMBLY

CROSS-REFERENCES none

GOVERNMENT RIGHTS none

BACKGROUND

This invention relates generally to a removable mullion assembly, and more particularly concerns a mullion assembly including a retaining element housing a locking mechanism for securing the mullion in a door opening.

A mullion is generally defined as a slender vertical, usually nonstructural, bar or pier forming a division between window panes, doors or screens. Mullions dividing door openings are usually fixed with the separation between the doors, or banks of doors, and made as part of the frame. These mullions generally cannot be removed. However, some door openings which function as single doors occasionally require double door width, such as to move equipment. Removable mullions are used in these applications.

A removable mullion assembly provides a means for selectively converting a double door opening for use with single doors. The mullion assembly includes a mullion and top and bottom fittings, or brackets, which are attached to the floor and the top of the door frame. The mullion is an elongated bar which is vertically mounted to the fittings in the door opening. The mullion extends from the top of the door frame to the floor. Strikes are provided on opposite sides of the mullion to accommodate the single door latches.

When unobstructed access through the door opening is needed, the mullion is removed from the fittings. Usually, fasteners are used to mount the mullion to the fittings so that removal of the fasteners frees the mullion. Some mullions are pivotally attached to the top or bottom fitting which allows the mullion to be swung out of the door opening while remaining attached to the door frame. Other mullion assemblies include releasable latch mechanisms for securing the mullion in place and simplifying removal. In such mullion assemblies, the latch mechanism components are positioned in the mullion and one or both of the fittings. Mullion assemblies including latch mechanisms are sometimes provided with key-operated cylinder locks for operating the latch and to protect the mullion against unauthorized removal.

One problem with current key-operated removable mullions is the cylinder lock, and thus many of the latch and lock components, are housed within the mullion. When the mullion is removed to permit use of the door opening, there is a possibility that the components of the latch and cylinder lock can be damaged or contaminated. Moreover, having latch and lock components in both the mullion and the fittings is inconvenient, both in terms of manufacture and use. Since mullions are essentially nothing more than hollow tubes, this arrangement adds unnecessary complication to a generally simple structural member.

For the foregoing reasons, there is a need for a removable mullion assembly wherein the key-operated cylinder lock and other latch and lock components are contained entirely within one or both of the fittings. The new mullion assembly, and particularly the fittings, should also be simple to manufacture and use.

SUMMARY

Accordingly, it is an object of the present invention to provide a new mullion assembly having a locking mechanism for securing the mullion in the door opening, wherein all of the latch and lock components are in a fitting.

A further object of the present invention is to provide a new fitting for use with a mullion assembly, the new fitting housing all of the lock and latch components for securing the mullion in position in the door opening, including a cylinder lock.

Still another object of this invention is to provide a mullion assembly in which the fitting housing the locking mechanism for the mullion is adapted for use as either a top or bottom fitting.

The present invention is directed to a device that satisfies these needs. The device having features according to the present invention comprises a removable mullion assembly which is mountable in an opening between a floor and a door frame for adapting the opening in a door frame to receive a pair of single doors. The mullion assembly comprises a mullion and a retaining element adapted to be attached in the door opening for receiving an end of the mullion. The retaining element includes a locking mechanism disposed in the retaining element for selectively holding the mullion in place in the retaining element. In one position of the locking mechanism, the mullion is secured in an upright position in the door opening, and, in a second position, the mullion is disengaged from the retaining element to permit removal of the mullion from the door opening.

The locking mechanism comprises a latch bolt for engaging the end of the mullion and securing the mullion in the retaining element. Preferably, the latch bolt is slidable in the retaining element between an extended position for engaging the end of the mullion and a retracted position away from the mullion to allow the mullion to be removed. In one embodiment, the latch bolt is a plate and the mullion has longitudinally extending slots formed in opposite sides thereof for receiving the plate and securing the mullion in the retaining element.

Means are provided in the locking mechanism for moving the bolt to the retracted position. One such means includes a key-operated mechanism, such as a cylinder lock, which is operatively connected to the bolt for moving the latch bolt to the retracted position in response to turning the key in the cylinder. Another retracting means contemplated for use with the present invention comprises an actuating element adapted to be activated by the end of the mullion as the mullion enters the retaining element for moving the bolt to the retracted position.

The locking mechanism may further comprise means for locking the bolt in the extended position. For example, a blocking element is employed which is movable between a first position to block movement of the latch bolt from the extended position, and a second position allowing movement of the latch bolt to the retracted position. In one embodiment, the blocking element may be moved to the second, non-blocking position as the mullion is inserted into the retaining element by a release lever which is actuated by the end of the mullion, or in response to turning the key in the cylinder.

The present invention features a box-shaped fitting for housing all of the latch and lock components. Preferably, this is the top fitting, but may be the bottom fitting. One of the walls of the fitting has an opening for receiving the end of the mullion in an upright position in the door frame. The present invention allows the mullion to be mounted to the top fitting and in the door opening without the need for latch or lock components in the mullion. Having the lock mechanism permanently mounted in the fitting prevents damage and contamination to the components thereof when the mullion is removed and laid on the floor. Also, this arrangement allows the use of a standard mullion, so that the fitting can be retrofit to existing installations. The fitting and locking mechanism are simply designed, easy to manufacture and less bulky to inventory than conventional mullion assemblies.

BRIEF DESCRIPTION OF THE DRAWINGS

For a more complete understanding of this invention reference should now be had to the embodiments illustrated in greater detail in the accompanying drawings and described below.

DESCRIPTION

Figure 1:
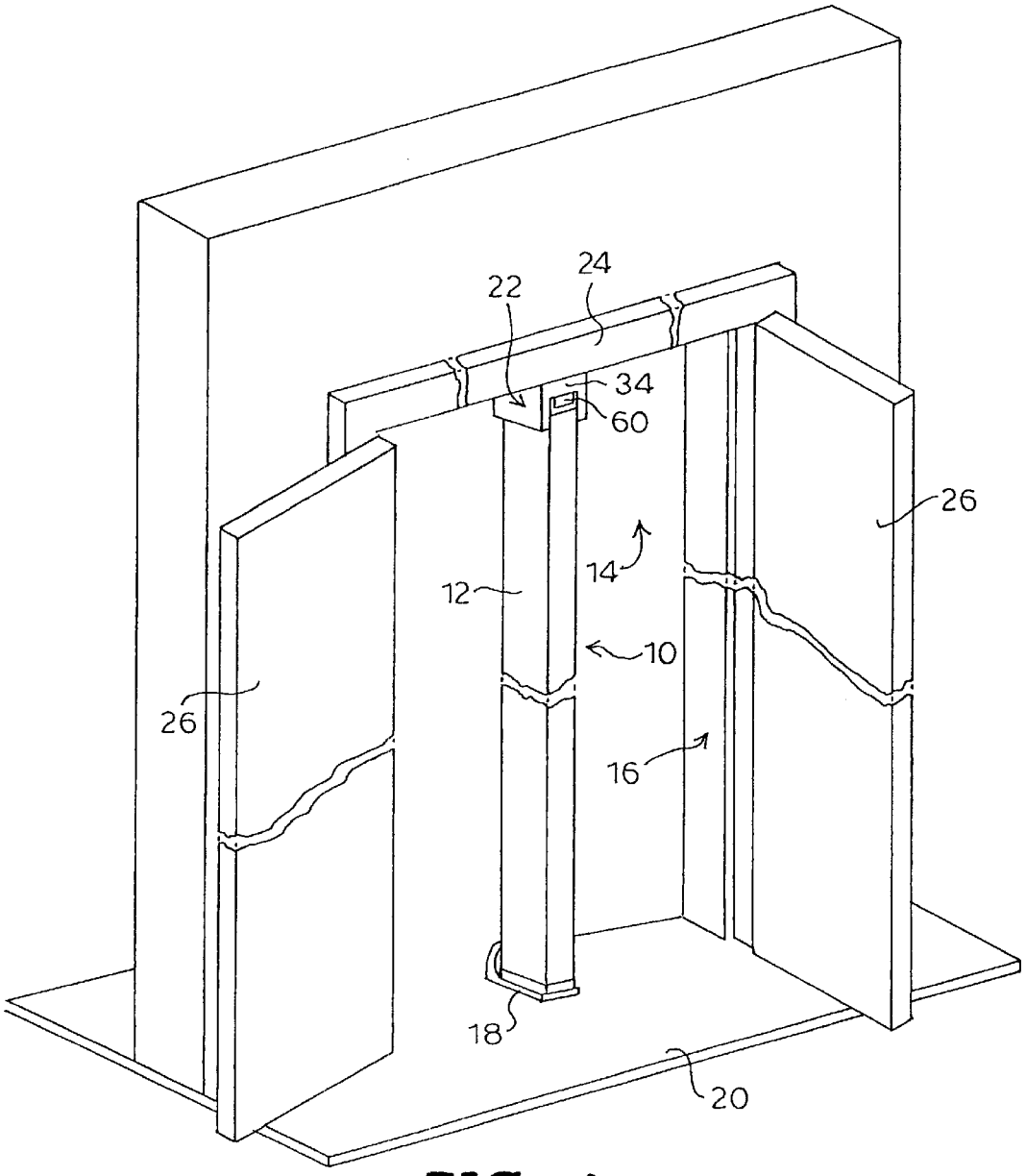
FIG. 1 is a perspective view of a pair of doors in a door opening having a removable mullion assembly according to the present invention installed in the opening.

Turning now to the drawings, there is shown in FIG. 1 a removable mullion assembly, including features of the present invention and generally designated at 10. The mullion assembly 10 includes a mullion 12 which is vertically mounted in an opening 14 defined by a door frame 16. The mullion 12 is retained between a bottom fitting 18 attached to the floor 20 and a top fitting 22 attached to the top of the door frame 24 above the bottom fitting. The lower end of the mullion 12 defines a cavity which fits over the bottom fitting 18 while the upper end of the mullion 12 slips into the top fitting 22. With the mullion 12 in place, the opening 14 is adapted to receive a pair of doors 26 which close against the front wall 34 of the mullion 12. Strike plates (not shown) may be mounted on opposite sides of the mullion 12 for receiving latch bolts (not shown) extending from the doors 26.

Mullion assemblies are typically metallic, such as steel or aluminum. However, the scope of the invention is not intended to be limited by the materials listed here, but may be carried out using any material which allows the construction and operation of the mullion assembly described herein.

The mullion 12 used in the present invention is conventional, comprising an elongated, one-piece tubular member of generally rectangular, horizontal cross-section. The bottom fitting 18 is also conventional and is provided with an integral upstanding boss which fits inside the mullion 12. The bottom fitting 18 includes a flat base portion having vertical holes for receiving screws, or other fastening elements, for securing the bottom fitting to the floor 20 in the door opening 14. The bottom fitting 18 further includes a protrusion configured to fit against the outside surface of the mullion 12 and with a threaded opening for receiving a set screw for holding the mullion in position on the bottom fitting. Other means for attaching or securing the mullion 12 to the bottom fitting 18 may be used within the scope of the invention, such as slip bolts, hinges, pivot pins, interlocking flanges, exterior stops and the like. Preferably, the attachment mechanism allows the mullion 12 to pivot slightly on the bottom fitting.

Figure 2:
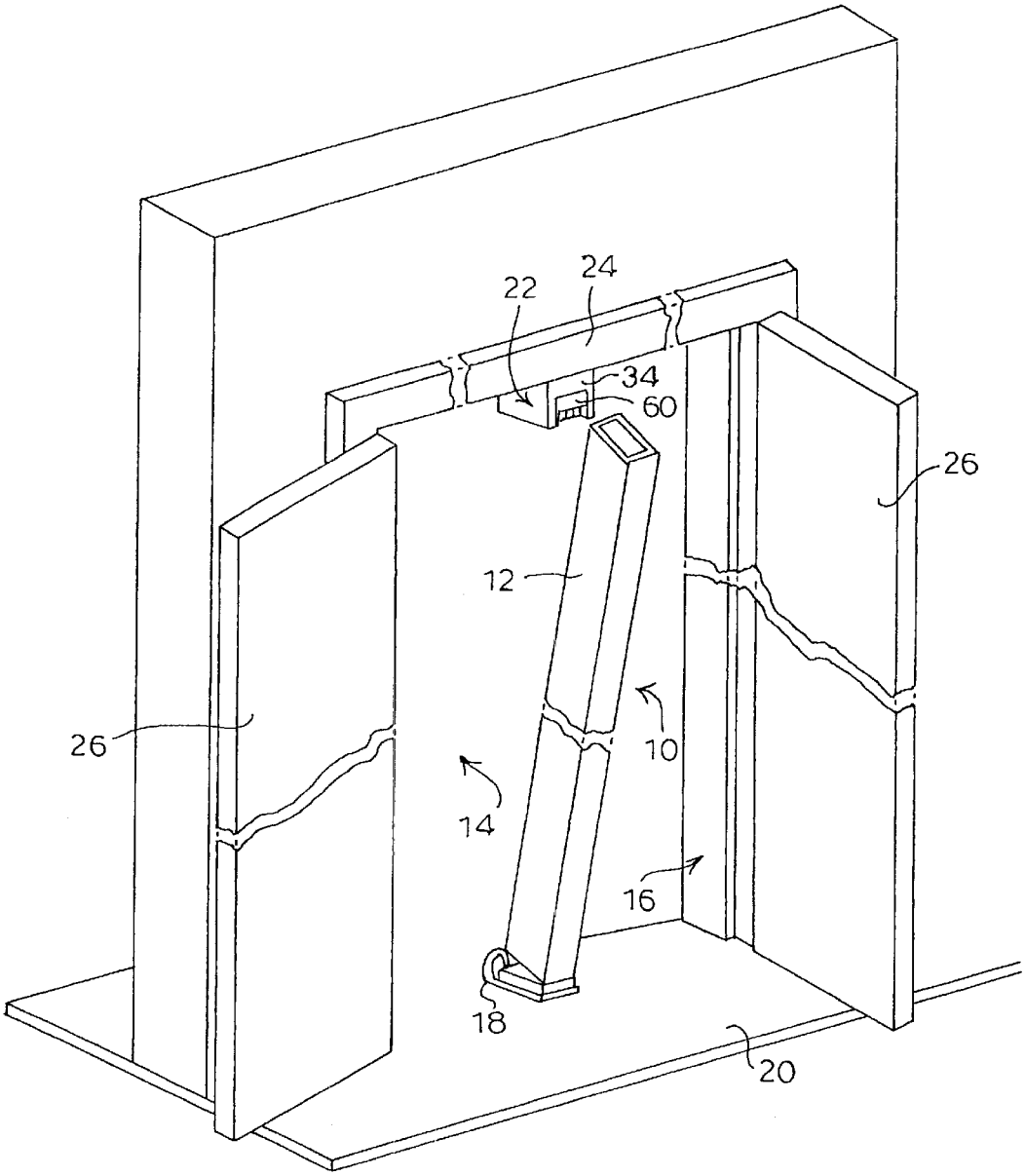
FIG. 2 is a perspective view of the pair of doors in the door opening of FIG. 1, the mullion out of vertical position disengaged from the top fitting.

In the embodiment shown in FIG. 2, the mullion 12 is removable for allowing unobstructed access through the opening 14 by tilting the mullion 12 out of and away from the top fitting 22. The mullion 12 is then lifted off of the bottom fitting 18. Installation of the mullion 12 is the reverse of removal, the mullion 12 is placed over the bottom fitting 18 and pivoted into the top fitting 22.

Figure 3:
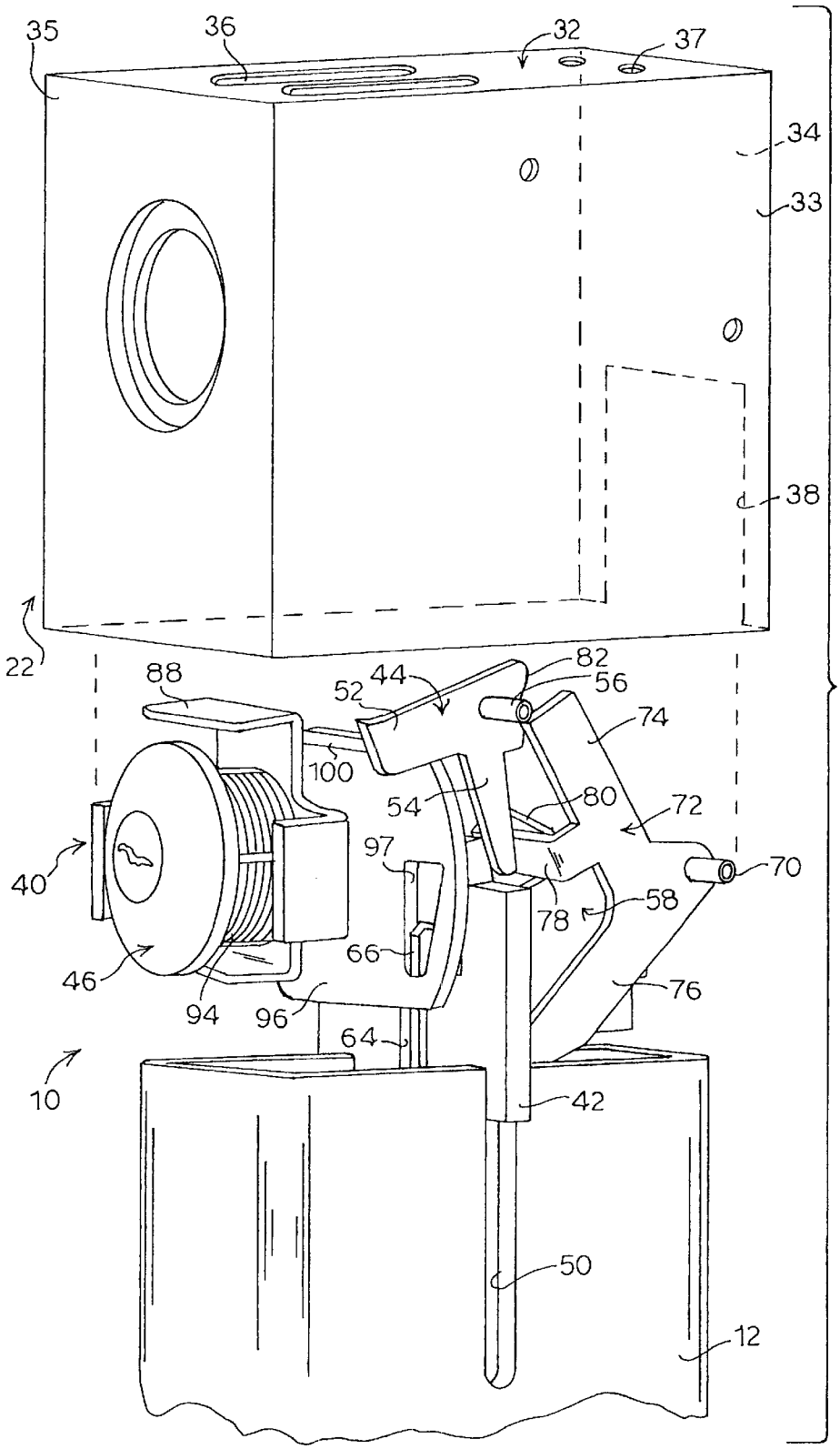
FIG. 3 is an exploded view of an embodiment of the top fitting and lock mechanism according to the present invention showing the lock mechanism in engagement with the end of the mullion.

The top fitting 22 and mullion locking mechanism 40 are shown in FIG. 3. The top fitting 22 is generally rectangular in shape having a substantially flat base 32, spaced parallel side walls 33, a front wall 35 and a rear wall 35. The base 32 is provided with elongated slots 36 and holes 37 for receiving fastening elements, such as screws, for attaching the fitting to the top of the door frame or a fitting plate (not shown) already in place on the frame. Screws are initially loosely inserted in the elongated slots 36 so that the top fitting 22 may be shifted in order to properly align the top fitting directly over the bottom fitting. The front wall 34 of the top fitting 22 defines an opening 38 for receiving the upper end of the mullion 12.

The top fitting 22 supports the locking mechanism 40 for securely retaining the mullion 12 in position in the opening 14. The locking mechanism 40 comprises a latch bolt 42, means for retracting the latch bolt, a locking lever 44 and means for releasing the locking lever.

The latch bolt 42 is a flat plate which freely slides up and down in vertical grooves 48 (FIG. 4) in the side walls 33 of the top fitting 22. As seen in FIG. 3, the latch bolt 42 fits into vertical slots 50 in the top end of the mullion 12 for holding the mullion in place in the top fitting 22.

Figure 4:
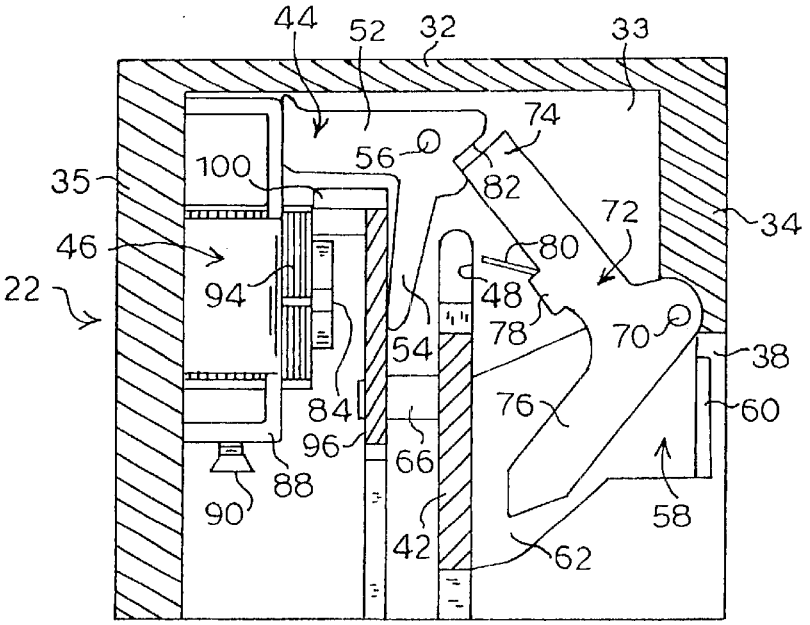
FIG. 4 is a sectional view of the top fitting and lock mechanism taken along line 4—4 of FIG. 3.
Figure 5:
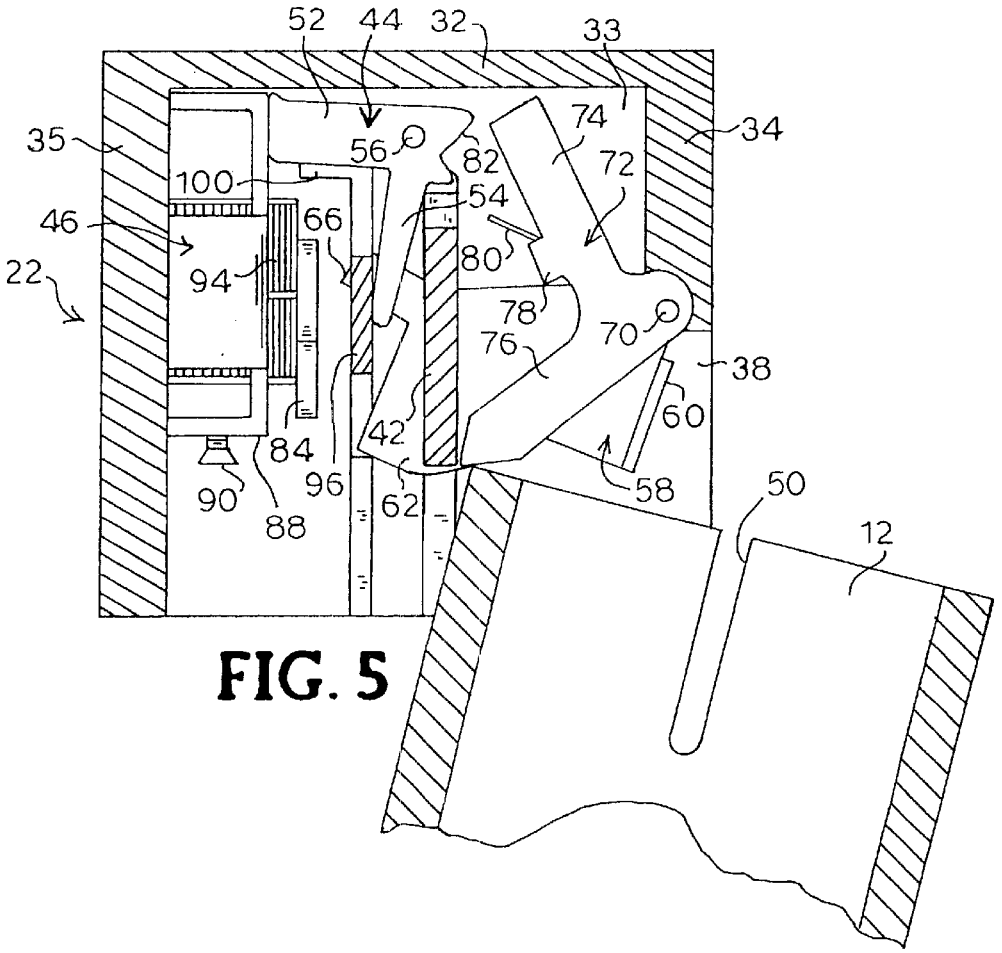
FIG. 5 is the same as FIG. 4 but showing the lock mechanism components with the top end of the mullion partially inserted into the top fitting.
Figure 9:
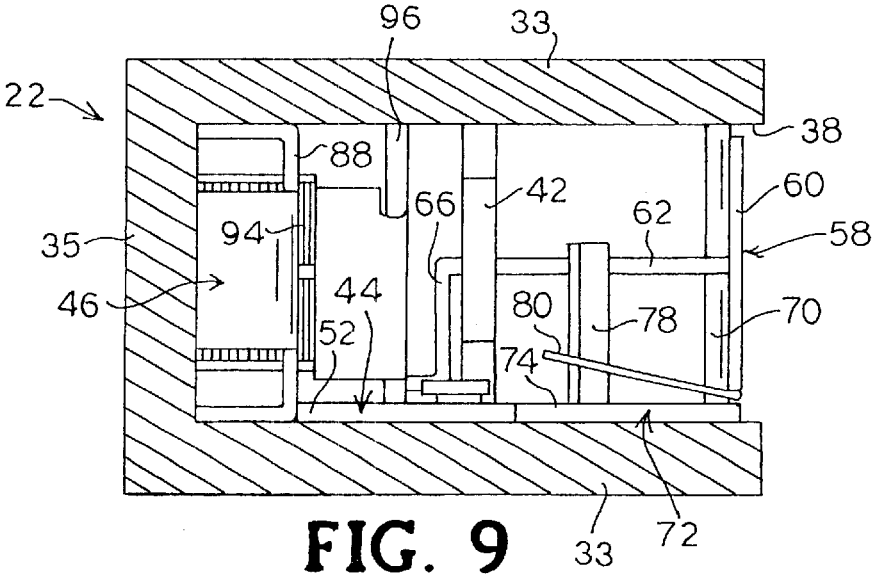
FIG. 9 is a top plan view taken along line 9—9 of FIG. 3.
Figure 10:
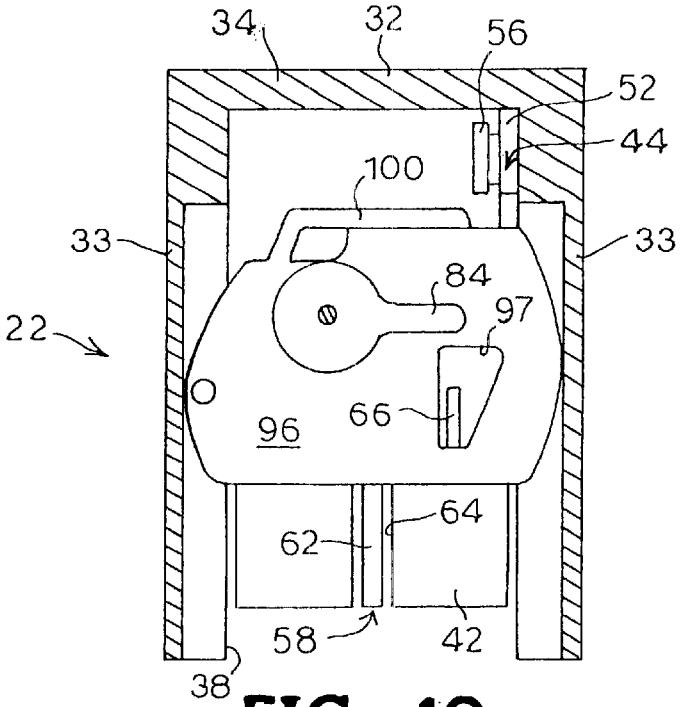
FIG. 10 is a front cross-section taken along line 10—10 of FIG. 3.
Figure 11:
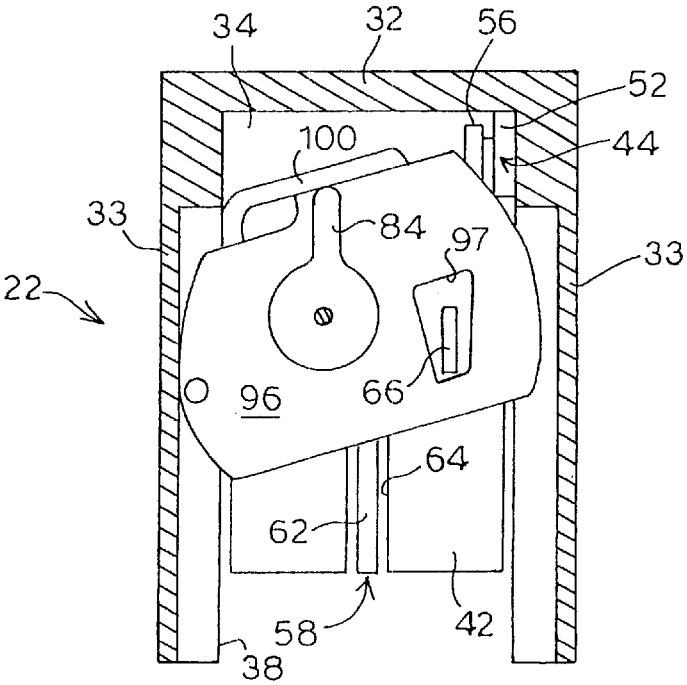
FIG. 11 is the same as FIG. 10 but showing the cylinder cam in a rotated position and raising the cylinder release lever.

One means for retracting the latch bolt 42 includes a latch bolt actuator 58 (FIG. 4). Referring to FIG. 9, the latch bolt actuator 58 is a T-shaped piece which is pivotally secured on a pin 70 to the rear wall 35 of the top fitting 22 above the opening 38. The pin 70 passes through a hole in the base portion 62 of the "T" adjacent the intersection of the base portion 62 and top portion 60. The top portion 60 of the latch bolt actuator 58 partially blocks the opening 38 in the front wall 34 of the top fitting 22. The base portion 62 extends forward and fits loosely in a slot 64 in the latch bolt 42.

Figure 6:
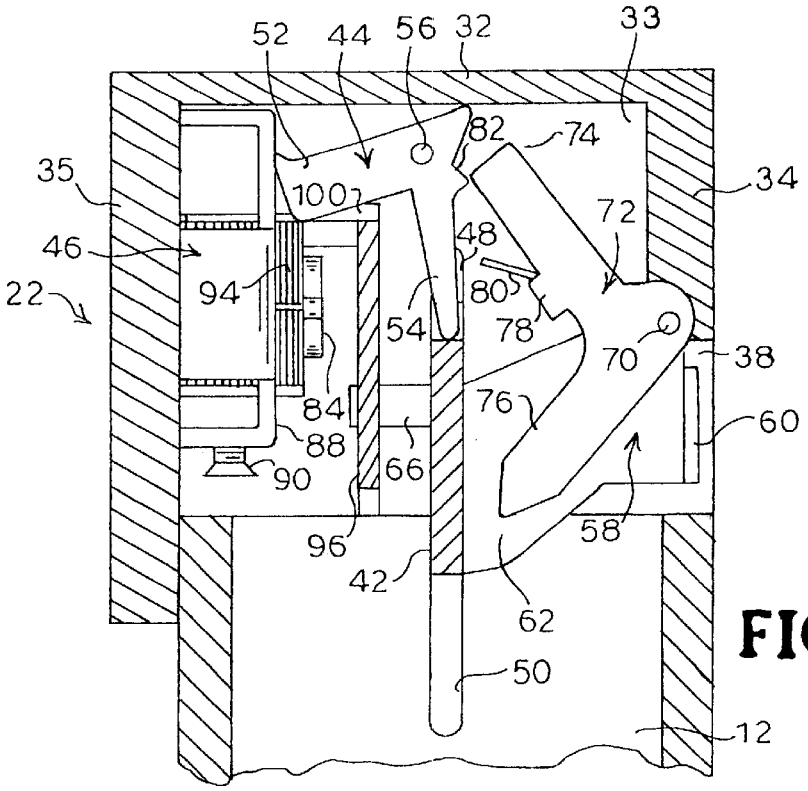
FIG. 6 is the same as FIGS. 4 and 5 but showing the top end of the mullion in vertical position in the top fitting and the latch bolt engaged in the slots in the end of the mullion.

The locking lever 44 is an L-shaped element having a large upper leg 52 and a smaller lower leg 54. The locking lever 44 pivots freely on a pin 56 passing through the intersection of the upper leg 52 and lower leg 54 of the locking lever 44 and into the side wall 33 of the top fitting 22. The pin 56 is located so that the weight and proportions of the upper leg 52 cause the locking lever 44 to rotate in a counter-clockwise direction, as seen in the FIGS., at least until the upper rightmost portion of the locking lever engages the base 32 of the top fitting 22 (FIG. 6). In this position, the lower leg 54 of the locking lever 44 blocks the path of the latch bolt 42 when the latch bolt is in the mullion slots 50 and prevents unwanted raising of the latch bolt 22. The locking lever 44 can alternatively be spring biased to the blocking position.

Means for releasing the locking lever 44 are provided, comprising a lock release lever 72 for holding the locking lever 44 clear of the bolt slots 48 when the mullion 12 is not in the top fitting 22. The lock release lever 72 is an L-shaped piece and pivots at the intersection of the upper leg 74 and lower leg 76 on the same pin 70 as the latch bolt actuator 58. As seen in FIG. 9, the lock release lever 72 includes an inwardly projecting arm 78 integral with the upper leg 74. A torsion spring 80 surrounds the pin 70. One end of the spring 80 engages the rear wall 35 of the top fitting 22 and the other end engages the arm 78 thus biasing the lock release lever 72 in a counter clockwise direction as seen in FIG. 4. When the mullion 12 is not in the top fitting 22, as in FIG. 4, the upper leg 74 of the lock release lever 72 engages a notch 82 in the rear of the locking lever 44 thereby rotating the locking lever 44 clockwise and out of the path of the latch bolt 42. When the mullion 12 is in the top fitting 22 (FIG. 6), the upper wall of the mullion engages the lower leg 76 of the lock release lever preventing the lock release lever from engaging the locking lever 44 thus allowing the locking lever 44 to fall into a position blocking the latch bolt 42. The end of the lower leg 76 may be angled inward to facilitate this engagement.

Installing the mullion is accomplished as shown in FIG. 2. The top and bottom fittings are installed and the mullion post is positioned at an angle over the bottom fitting. The mullion 12 is then swung toward the top fitting. As the mullion approaches vertical position, the upper end enters the opening in the rear wall of the top fitting and engages the base 62 of the latch bolt actuator 58. The mullion 12 pivots the latch bolt actuator 58 upward raising the latch bolt 42 and lock release lever 72 and allowing the end of the mullion to enter the top fitting 22. When the mullion 12 reaches vertical position in the top fitting 22 (FIG. 6), the latch bolt 42 drops down into the mullion slots 50 securing the mullion 12 in place. Since the lock release lever 72 rests on top of the mullion 12, the locking lever drops down into the path of the latch bolt 42 maintaining the latch bolt 42 in the locked position. The latch bolt actuator cannot be raised by pressing on the top potion 60 of the latch bolt actuator 58. The mullion 12 remains in the locked position until the latch bolt 42 is raised by the user.

Means are provided for releasing the locking mechanism when the mullion is in the top fitting 22, comprising a cylinder lock mechanism 46 which is positioned in the top fitting 22 so as to be externally accessible. The cylinder lock 46 includes a key-operated cylinder 94, cylinder a rotatable cam 84 at the inner end of the cylinder 94 adjacent a release plate 96. The cylinder 94 is secured by an anti-rotation plate 88 fastened to the top fitting 22 and a set screw 90 which fits in a groove 92 in the cylinder 94 to prevent rotation of the cylinder 94. The cylinder release plate 96 is pivotally secured in the side wall 33 of the top fitting 22. The upper edge of the cylinder release plate 96 has a flange 100 which serves as a camming surface. The release plate 96 also has an opening 97 for receiving a hook-shaped arm 66 integral with the base portion 62 of the latch bolt actuator 58.

Figure 7:
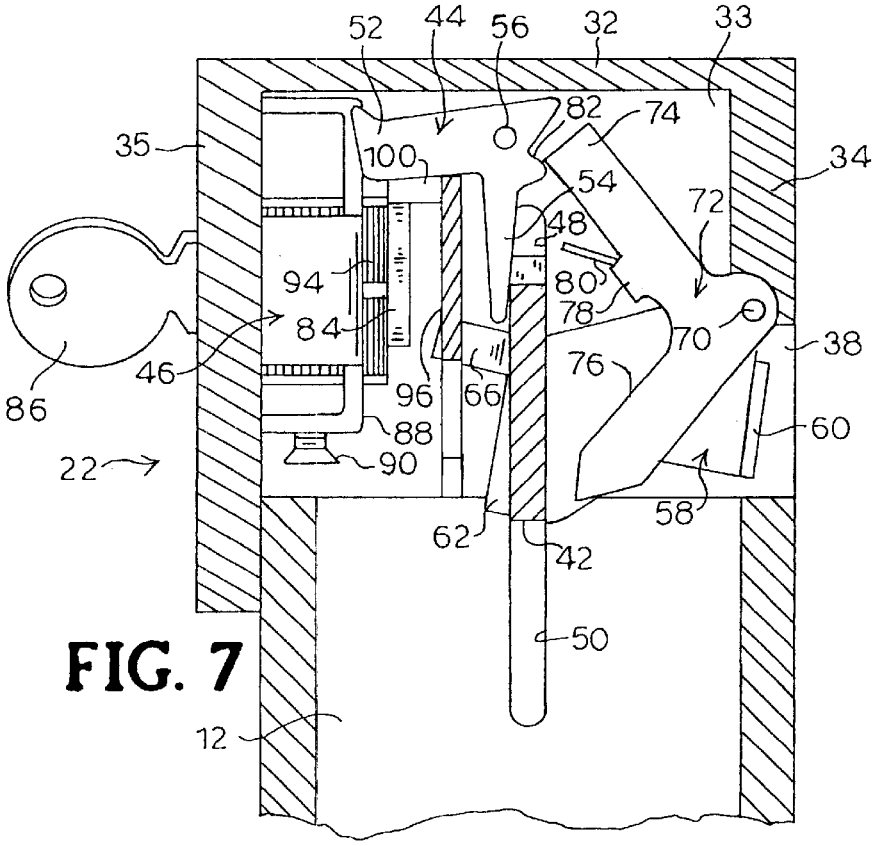
FIG. 7 is the same as FIGS. 4–6 but showing the lock mechanism components upon initial raising of the cylinder release and clockwise rotation of the locking lever.
Figure 8:
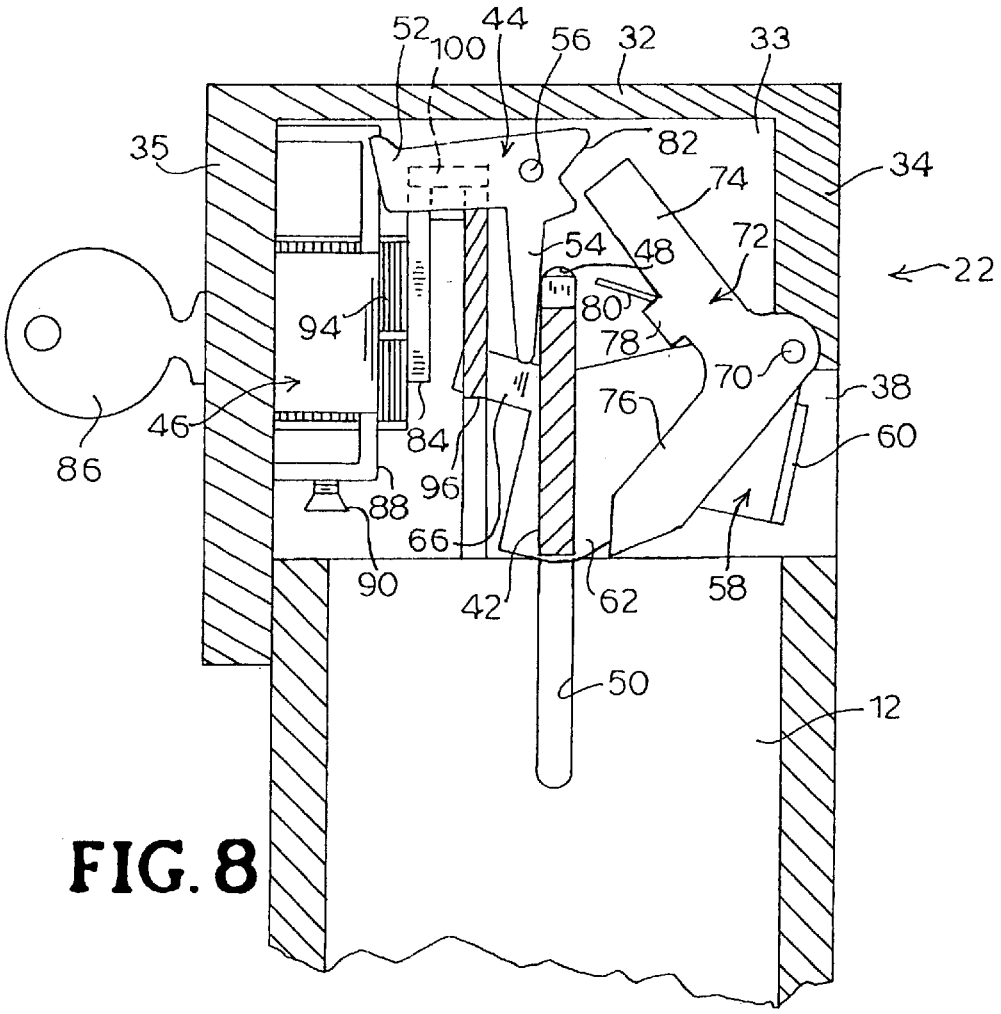
FIG. 8 is the same as FIGS. 4–7 but showing the lock mechanism components after continued rotation of the cylinder cam raising of the latch bolt by the cylinder release lever.

Referring to FIGS. 7 and 8, the latch bolt 42 is raised for removal of the mullion in response to activation of the key-operated cylinder 94. As the cam 84 is rotated by a key 86 in the cylinder 94, the cam 84 engages and moves the cam along the flange 100 on the cylinder release plate 96 and pivots the release plate 96 upward. As the cylinder release plate 96 begins to ascend, the upper edge initially engages the locking lever 44 rotating the locking lever 44 out of the path of the latch bolt 42. Continued rotation of the key and cylinder cam 84 slides the cam along the flange 100 continuing to drive the cylinder release plate upward and raising the latch bolt actuator 58 as the bottom edge of the opening in the release palte 96 engages the arm 66 on the actuator 58. Consequently the latch bolt 42 is raised out of the mullion slots 50 (FIG. 8). This breaks the locking connection between the locking mechanism 40 and the mullion 12. The mullion 12 can then be pivoted out of the top fitting 22 and lifted off of the bottom fitting 18. Of course, if the user does not want to remove the mullion 12, rotating the key in the opposite direction causes the cylinder cam 84 to rotate away from the cylinder release plate 96 and allow the latch bolt 42 to fall down into the mullion slots 50.

It is understood that other locking or latching mechanisms can be employed for engaging with the mullion, including conventional bolts, latches or other throw mechanisms triggered by rotation of the cylinder cam to engage the mullion. In addition, it is also possible to reverse the fittings of the mullion assembly by positioning the fitting housing the locking mechanism on the floor and the other fitting at the top of the door frame. In this arrangement, the bottom fitting would house the locking mechanism which would require means for upwardly biasing the locking mechanism components that rely on gravity to function.

The removable mullion assembly of the present invention has many advantages, including providing an easy to use, convenient mullion assembly in which all of the locking components are housed within the top fitting. The new fitting provides a secure latching mechanism while permitting easy removal of the mullion when necessary to utilize the full door opening. There is no concern that the lock components will be damaged or contaminated when the mullion is removed. The latch mechanism is easy to manufacture and use. Moreover, since the locking mechanism is self-contained within the top fitting, the top fitting may be used to retrofit existing mullion assemblies rendering them secure while providing all of the advantages of the present invention.

Although the present invention has been shown and described in considerable detail with respect to only a few exemplary embodiments thereof, it should be understood by those skilled in the art that I do not intend to limit the invention to the embodiments since various modifications, omissions and additions may be made to the disclosed embodiments without materially departing from the novel teachings and advantages of the invention, particularly in light of the foregoing teachings. For example, the bottom fitting may house the locking mechanism as noted above. Accordingly, I intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

I claim:

1. A removable mullion assembly mountable in a doorway opening defined by a floor and a door frame extending vertically upward from the floor, the mullion assembly adapting the opening to receive a pair of single doors, the mullion assembly comprising:

a mullion to be placed in an upright position in the doorway opening for dividing the opening to receive the pair of single doors, and a retaining element adapted to be attached to one of the floor or the door frame, the retaining element having a base and four walls depending from the base including two oppositely disposed parallel side walls and a front wall and a rear wall joining the ends of the side walls, the base and walls of the retaining element defining a cavity and one of the walls having an opening allowing an end of the mullion to be positioned in the cavity through the one wall when the mullion is placed in the upright position in the doorway opening, the retaining element comprising a locking mechanism disposed in the retaining element for selectively holding the mullion in place in the retaining element when the locking mechanism is in a locked position where the locking mechanism engages the mullion for securing the mullion in the upright position and an unlocked position where the locking mechanism is disengaged from the mullion to permit removal of the mullion from the retaining element through the one wall.

2. A mullion assembly as recited in claim 1, wherein the retaining element is adapted to be attached to the top of the door frame.

3. A mullion assembly as recited in claim 1, wherein the locking mechanism comprises a latch bolt for engaging the end of the mullion and securing the mullion in the retaining element in the locked position of the locking mechanism.

4. A mullion assembly as recited in claim 3, wherein the locking mechanism further comprises means for moving the latch bolt to the retracted position.

5. A mullion assembly as recited in claim 4, wherein the retracting means comprises a key-operated mechanism operatively connected to the latch bolt for moving the latch bolt to the retracted position.

6. A mullion assembly as recited in claim 5, wherein the key-operated mechanism comprises a cylinder lock.

7. A mullion assembly as recited in claim 6, further comprising a cylinder cam on the cylinder, the cam rotatable with the key in the cylinder and operatively connected to the latch bolt for moving the latch bolt to the retracted position in response to turning the key in the cylinder.

8. A mullion assembly as recited in claim 4, wherein the retracting means comprises an actuating element disposed in the retaining element for movement between a first position and a second position, the actuating element operatively connected to the latch bolt so that the first and second positions of the actuating element correspond to the extended and retracted position of the latch bolt, respectively, the actuating element adapted to engage the end of the mullion as the mullion enters the retaining element through the rear wall so that the entering mullion moves the actuating element from the first position to the second position for moving the latch bolt to the retracted position.

9. A mullion assembly as recited in claim 3, wherein the locking mechanism further comprises means for moving the bolt to the extended position.

10. A mullion assembly as recited in claim 3, wherein the locking mechanism further comprises means for locking the latch bolt in the extended position.

11. A removable mullion assembly mountable in a doorway opening defined by a floor and a door frame extending vertically upward from the floor, the mullion assembly adapting the opening to receive a pair of single doors, the mullion assembly comprising:

a mullion to be placed in an upright position in the doorway opening for dividing the opening to receive the pair of single doors, and a retaining element adapted to be attached to one of the floor or the door frame, the retaining element having a base and four walls depending from the base including tow oppositely disposed parallel side walls and a front wall and a rear wall joining the ends of the side walls, the base and walls of the retaining element defining a cavity and one of the walls having an opening for allowing an end of the mullion to be positioned in the cavity through the one wall when the mullion is paced in the upright position in the doorway opening, the retaining element comprising a locking mechanism disposed in the retaining element for selectively holding the mullion in place in the retaining element when the locking mechanism is in a locked position where the locking mechanism engages the mullion for securing the mullion in an upright position in the doorway opening and an unlocked position where the locking mechanism is disengaged from the mullion to permit removal of the mullion from the retaining element through the one wall, wherein the locking mechanism comprises a latch bolt which is reciprocally slidable in the retaining element between an extended position and a retracted position, the latch bolt engaging the end of the mullion in the locked position of the locking mechanism and spaced from the end of the mullion when the latch bolt is in the retracted position in the unlocked position of the locking mechanism.

12. A removable mullion assembly mountable in a doorway opening defined by a floor and a door frame extending vertically upward from the floor, the mullion assembly adapting the opening to receive a pair of single doors, the mullion assembly comprising:

a mullion to be placed in an upright position in the doorway opening for dividing the opening to receive the pair of single doors, an end of the mullion having a longitudinal axis and a slot extending along the longitudinal axis; and a retaining element adapted to be attached to one of the floor of the door frame for receiving an end of the mullion, the retaining element comprising a locking mechanism disposed in the retaining element for selectively holding the mullion in place in the retaining element, the locking mechanism comprising a latch bolt comprising a plate slidably disposed in the retaining element for movement between an extended position and a retracted position, the plate adapted to be received in the slot in the end of the mullion when the plate is in the extended position for securing the mullion in the retaining element in the upright position in the doorway opening and spaced from the slot when the plate is in the retracted position for permitting removal of the mullion from the retaining element.

13. A mullion assembly as recited in claim 12, wherein the locking mechanism further comprises means for moving the latch bolt to the retracted position.

14. A mullion assembly as recited in claim 13, wherein the retracting means comprises a key-operated mechanism including a cylinder lock and a cam rotatably mounted on the cylinder, the cam adapted to be rotated by a key in the cylinder and operatively connected to the latch bolt for moving the latch bolt to the retracted position in response to turning the key in the cylinder.

15. A mullion assembly as recited in claim 13, wherein the retaining element has a base and four walls depending from the base including two oppositely disposed parallel side walls and a front wall and a rear wall joining the ends of the side walls, the base and walls of the retaining element defining a cavity and one of the walls having an opening for allowing an end of the mullion to be positioned in the cavity through the one wall, and the retracting means comprises an actuating element disposed in the retaining element for movement between a first position and a second position, the actuating element operatively connected to the latch bolt so that the first and second positions of the actuating element correspond to the extended and retracted position of the latch bolt, respectively, the actuating element adapted to engage the end of the mullion as the mullion enters the retaining element through the one wall so that the entering mullion moves the actuating element from the first position to the second position for moving the bolt to the retracted position.

16. A mullion assembly as recited in claim 12, wherein the locking mechanism further comprises means for locking the latch bolt in the extended position.

17. A removable mullion assembly mountable in a doorway opening defined by a floor and a door frame extending vertically upward from the floor, the mullion assembly adapting the opening in the door frame to receive a pair of single doors, the mullion assembly comprising:

a mullion to be placed in an upright position in the doorway opening for dividing the opening to receive the pair of single doors; and a retaining element adapted to be attached to one of the floor or the door frame for receiving an end of the mullion, the retaining element comprising a locking mechanism disposed in the retaining element for selectively holding the mullion in place in the retaining element, the locking mechanism comprising a latch bolt moveable between an extended position and a retracted position, the latch bolt engaging the end of the mullion in the extended position for securing the mullion in the retaining element in the upright position in the doorway opening and spaced from the end of the mullion in the retracted position for permitting removal of the mullion from the retaining element, and means for moving the latch bolt to the retracted position, the latch bolt moving means comprising an actuating element moveable between a first position and a second position, the actuating element operatively connected to the latch bolt so that the first and second positions of the actuating element correspond to the extended and retracted position of the latch bolt, respectively, a key-operated mechanism including a cylinder lock and a cam rotatably mounted on the cylinder, the cam adapted to be rotated by a key in the cylinder, and a moveable release lever having an abutment, the release lever operatively connected to the actuating element, the cylinder cam engaging the abutment upon rotation of the key in the cylinder for moving the release lever which moves the actuating element from the first position to the second position for moving the latch bolt to the retracted position in response to turning of the key in the cylinder for allowing movement of the mullion relative to the retaining element.

18. A mullion assembly as recited in claim 17, wherein the retaining element has a base and four walls depending from the base including two oppositely disposed parallel side walls and a front wall and a rear wall joining the ends of the side walls, the base and walls of the retaining element defining a cavity and one of the walls having an opening for allowing an end of the mullion to be positioned in the cavity through the rear wall, and wherein the actuating element is adapted to engage the end of the mullion as the mullion enters the retaining element through the one wall so that the entering mullion moves the actuating element from the first position to the second position for moving the bolt to the retracted position.

19. A mullion assembly as recited in claim 17, wherein the locking mechanism further comprises means for locking the latch bolt in the extended position.

20. A removable mullion assembly mountable in a doorway opening defined by a floor and a door frame extending vertically upward from the floor, the mullion assembly adapting the opening to receive a pair of single doors, the mullion assembly comprising:

a mullion to be placed in an upright position in the doorway opening for dividing the opening to receive the pair of single doors, and a retaining element adapted to be attached to one of the floor or the door frame, the retaining element having a base and four walls depending from the base including two oppositely disposed parallel side walls and a front wall and a rear wall joining the ends of the side walls, the base and walls of the retaining element defining a cavity and one of the walls having an opening for allowing an end of the mullion to be positioned in the cavity through the one wall when the mullion is placed in the upright position in the doorway opening, the retaining element comprising a locking mechanism disposed in the retaining element for selectively holding the mullion in place in the retaining element when the locking mechanism is in a locked position where the locking mechanism engages the mullion for securing the mullion in the upright position in the doorway opening and an unlocked position where the locking mechanism is disengaged from the mullion to permit removal of the mullion from the retaining element through the one wall, wherein the locking mechanism comprises a latch bolt which is reciprocally slidable in the retaining element between an extended position and a retracted position, the latch bolt engaging the end of the mullion in the extended position for securing the mullion in the retaining element in the locked position of the locking mechanism and spaced from the end of the mullion when the latch bolt is in the retracted position in the unlocked position of the locking mechanism and means for locking the latch bolt in the extended position, wherein the locking means comprises an arm movable between a first position where the arm blocks movement of the latch bolt from the extended position and a second position where the arm allows movement of the latch bolt from the extended position to the retracted position.

21. A mullion assembly as recited in claim 20, wherein the locking mechanism further comprises a moveable release lever having a first surface for holding the arm in the second position and having a second surface for engaging the end of the mullion as the mullion is inserted into the retaining element through the one wall so that the entering mullion moves the first surface of the release lever away from the arm allowing the arm to move from the second position to the first position.

22. A retaining element for use in a removable mullion assembly mountable in a doorway opening defined by a floor and a door frame extending vertically upward from the floor, the mullion assembly including a mullion to be placed in an upright position in the doorway opening for adapting the opening to receive a pair of single doors, the retaining element comprising:

a housing defining a cavity, the housing adapted to be attached to one of the floor or the door frame and having an opening in one side allowing an end of the mullion to be positioned in the cavity through the side opening when the mullion is placed in the upright position in the doorway opening; and a locking mechanism disposed in the housing for selectively holding the mullion in place in the housing when the locking mechanism is in a locked position where the locking mechanism engages the mullion for securing the mullion in the upright position and an unlocked position where the locking mechanism is disengaged from the mullion to permit removal of the mullion from the housing through the side opening.

23. A mullion assembly as recited in claim 22, wherein the locking mechanism comprises a latch bolt for engaging the end of the mullion and securing the mullion in the housing in the locked position of the locking mechanism.

24. A mullion assembly as recited in claim 23, wherein the locking mechanism further comprises means for moving the latch bolt to the retracted position.

25. A mullion assembly as recited in claim 24, wherein the retracting means comprises a key-operated mechanism including a cylinder lock and a cam on the cylinder, the cam rotatable with the key in the cylinder and operatively connected to the latch bolt for moving the latch bolt to the retracted position in response to turning the key in the cylinder.

26. A mullion assembly as recited in claim 23, wherein the locking mechanism further comprises means for locking the latch bolt in the extended position.

27. A retaining element for use in a removable mullion assembly mountable in a doorway opening defined by a floor and a door frame extending vertically upward from the floor, the mullion assembly including a mullion to be placed in an upright position in the doorway opening for adapting the opening to receive a pair of single doors, the retaining element comprising:

a housing defining a cavity, the housing adapted to be attached to one of the floor or the door frame and having an opening in one side for allowing an end of the mullion to be positioned in the cavity through the side opening when the mullion is placed in the upright position in the doorway opening; and a locking mechanism disposed in the housing for selectively holding the mullion in place in the housing when the locking mechanism is in a locked position where the locking mechanism engages the mullion for securing the mullion in an upright position in the doorway opening and an unlocked position where the locking mechanism is disengaged from the mullion to permit removal of the mullion from the housing through the side opening, wherein the locking mechanism comprises a latch bolt for engaging the end of the mullion and securing the mullion in the housing in the locked position of the locking mechanism; and means for moving the latch bolt to the retracted position, the retracting means comprising an actuating element disposed in the housing for movement between a first position and a second position, the actuating element operatively connected to the latch bolt so that the first and second positions of the actuating element correspond to the extended and retracted position of the latch bolt, respectively, the actuating element adapted to engage the end of the mullion as the mullion enters the housing through the side opening so that the entering mullion moves the actuating element from the first position to the second position for moving the bolt to the retracted position.

28. A retaining element for use in a removable mullion assembly mountable in a doorway opening defined by a floor and a door frame extending vertically upward from the floor, the mullion assembly including a mullion to be placed in an upright position in the doorway opening for adapting the opening to receive a pair of single doors, the retaining element comprising:

a housing adapted to be attached to one of the floor or the door frame for receiving an end of the mullion, the housing having an opening in a side for allowing an end of the mullion to be positioned in the housing through the side opening when the mullion is placed in the upright position in the doorway opening; and a locking mechanism disposed in the housing for selectively holding the mullion in place in the housing, the locking mechanism comprising a latch bolt comprising a plate slidably disposed in the housing for reciprocal movement between an extended position and a retracted position, the place adapted to be received in a longitudinally extending slot formed in the end of the mullion when the plate is in the extended position for securing the mullion in the housing in an upright position in the doorway opening and spaced from the slot when the plate is in the retracted position for permitting removal of the mullion from the housing.

29. A mullion assembly as recited in claim 28, wherein the locking mechanism further comprises means for moving the latch bolt to the retracted position.

30. A mullion assembly as recited in claim 29, wherein the retracting means comprises a key-operated mechanism including a cylinder lock and a cam rotatably mounted on the cylinder, the cam adapted to be rotated by a key in the cylinder and operatively connected to the latch bolt for moving the latch bolt to the retracted position in response to turning the key in the cylinder.

31. A mullion assembly as recited in claim 28, wherein the locking mechanism further comprises means for locking the latch bolt in the extended position.

32. A retaining element for use in a removable mullion assembly mountable in a doorway opening defined by a floor and a door frame extending vertically upward from the floor, the mullion assembly including a mullion to be placed in an upright position in the doorway opening for adapting the opening to receive a pair of single doors, the retaining element comprising:

a housing adapted to be attached to one of the floor or the door frame for receiving an end of the mullion the housing having an opening in a side for allowing an end of the mullion to be positioned in the housing through the side opening when the mullion is placed in the upright position in the doorway opening; and a locking mechanism disposed in the housing for selectively holding the mullion in place in the housing, the locking mechanism comprising a latch bolt comprising a plate slidably disposed in the housing for reciprocal movement between an extended position and a retracted position, the plate adapted to be received in a longitudinally extending slot formed in the end of the mullion when the plate is in the extended position for securing the mullion in the housing in an upright position in the doorway opening and spaced from the slot when the plate is in the retracted position for permitting removal of the mullion from the housing, and means for moving the latch bolt to the retracted position, the retracting means comprising an actuating element disposed in the housing for movement between a first position and a second position, the actuating element operatively connected to the latch bolt so that the first and second positions of the actuating element correspond to the extended and retracted position of the latch bolt, respectively, the actuating element adapted to engage the end of the mullion as the mullion enters the housing through the side opening so that the entering mullion moves the actuating element from the first position to the second position for moving the bolt to the retracted position.

33. A retaining element for use in a removable mullion assembly mountable in a doorway opening defined by a floor and a door frame extending vertically upward from the floor, the mullion assembly including a mullion to be placed in an upright position in the doorway opening for adapting the opening to receive a pair of single doors, the retaining element comprising:

a housing adapted to be attached to one of the floor or the door frame for receiving an end of the mullion when the mullion is placed in the upright position in the doorway opening, a locking mechanism disposed in the housing for selectively holding the mullion in place in the housing, the locking mechanism comprising a latch bolt moveable between an extended position and a retracted position, the latch bolt engaging the end of the mullion in the extended position for securing the mullion in the housing in an upright position in the doorway opening and spaced from the end of the mullion in the retracted position for permitting removal of the mullion from the housing, and means for moving the latch bolt to the retracted position, the latch bolt moving means comprising an actuating element moveable between a first position and a second position, the actuating element operatively connected to the latch bolt so that the first and second positions of the actuating element correspond to the extended and retracted positions of the latch bolt, respectively, a key-operated mechanism including a cylinder lock and a cam rotatably mounted on the cylinder, the cam adapted to be rotated by a key in the cylinder, and a moveable release lever having an abutment, the release lever operatively connected to the actuating element, the cylinder cam engaging the abutment upon rotation of the key in the cylinder for moving the release lever which moves actuating element from the first position to the second position for moving the latch bolt to the retracted position in response to turning of the key in the cylinder for allowing movement of the mullion relative to the housing.

34. A mullion assembly as recited in claim 33, wherein the housing has an opening in one side for allowing an end of the mullion to be positioned in the housing through the side opening, and wherein the actuating element is adapted to engage the end of the mullion as the mullion enters the housing through the side opening so that the entering mullion moves the actuating element from the first position to the second position for moving the bolt to the retracted position.

35. A mullion assembly as recited in claim 33, wherein the locking mechanism further comprises means for locking the latch bolt in the extended position.

* * * * *

UNITED STATES PATENT AND TRADEMARK OFFICE

CERTIFICATE OF CORRECTION

PATENT NO. : 6,427,387 B1
DATED : August 6, 2002
INVENTOR(S) : Larry R. Hunt

It is certified that error appears in the above-identified patent and that said Letters Patent is hereby corrected as shown below:

Column 8,
Line 15, change "tow" instead to -- two --;
Line 19, change "paced" instead to -- placed --;
Line 35, in front of "locked" insert -- extended position for securing the mullion in the retaining element in the --.

Column 12,
Line 44, change "place" instead to -- plate --.

Signed and Sealed this

Fifth Day of November, 2002

*Attest:*

*Attesting Officer*

JAMES E. ROGAN
*Director of the United States Patent and Trademark Office*